US012612747B2

(12) United States Patent
Buschmann et al.

(10) Patent No.: US 12,612,747 B2
(45) Date of Patent: Apr. 28, 2026

(54) METHOD OF PAVING A ROAD SURFACE AND ASPHALT PAVING SYSTEM

(71) Applicant: JOSEPH VOEGELE AG, Ludwigshafen/Rhein (DE)

(72) Inventors: Martin Buschmann, Neustadt (DE); Ralf Weiser, Ladenburg (DE); Tobias Noll, Roschbach (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 1050 days.

(21) Appl. No.: 17/691,302

(22) Filed: Mar. 10, 2022

(65) Prior Publication Data

US 2022/0290383 A1 Sep. 15, 2022

(30) Foreign Application Priority Data

Mar. 10, 2021 (EP) ..... 21161843

(51) Int. Cl.

| | |
|---|---|
| ***E01C 23/07*** | (2006.01) |
| ***E01C 19/00*** | (2006.01) |
| ***E01C 19/48*** | (2006.01) |
| ***E01C 23/088*** | (2006.01) |

(52) U.S. Cl.

CPC ..... *E01C 23/07* (2013.01); *E01C 19/004* (2013.01); *E01C 19/48* (2013.01); *E01C 23/088* (2013.01)

(58) Field of Classification Search

CPC ..... E01C 19/004; E01C 19/48; E01C 23/07; E01C 23/088

USPC ..... 404/72, 75, 84.05–84.8, 89–94, 96, 117, 404/118

See application file for complete search history.

(56) References Cited

U.S. PATENT DOCUMENTS 4,473,319 A * 9/1984 Spangler ..... B60G 17/0165 73/146
8,855,967 B1 * 10/2014 Brenner ..... E01C 23/01 702/158

(Continued)

FOREIGN PATENT DOCUMENTS

CN 102797215 A 11/2012
CN 104233934 A 12/2014

(Continued)

OTHER PUBLICATIONS

Extended European Search Report for EP Application No. 21161843.4-1002 dated Aug. 27, 2021, 6 Pages.

(Continued)

*Primary Examiner* — Raymond W Addie
(74) *Attorney, Agent, or Firm* — BROOKS KUSHMAN P.C.

(57) ABSTRACT

A method for producing a road surface includes spatially measuring an existing road surface by a sensor; creating digital target milling profile; creating a digital target height profile of a road surface to be paved and calculating a layer thickness based on the target milling profile and the target height profile; at least partially automated controlling of a milling machine for milling an actual milling profile according to the specification of the target milling profile; spatially measuring the milled actual milling profile; and at least partially automated controlling of a road paver for paving the road surface in accordance with the specification of the target height profile.

20 Claims, 4 Drawing Sheets

(56) References Cited

U.S. PATENT DOCUMENTS

| | | | | |
|---|---|---|---|---|
| 8,930,092 | B2 * | 1/2015 | Minich | E01C 23/07 701/2 |
| 8,979,423 | B2 * | 3/2015 | Smieja | E01C 19/48 404/72 |
| 9,033,611 | B2 * | 5/2015 | Hanfland et al. | E01C 23/01 404/75 |
| 9,447,552 | B2 | 9/2016 | Buschmann et al. | |
| 10,563,362 | B2 | 2/2020 | O'Donnell et al. | |
| 11,193,245 | B2 | 12/2021 | Menzenbach et al. | |
| 12,039,866 | B2 | 7/2024 | Tomita et al. | |
| 2008/0038059 | A1 * | 2/2008 | Frelich | E01C 23/07 404/75 |
| 2015/0115689 | A1 * | 4/2015 | Snoeck | E01C 23/088 299/1.5 |
| 2015/0117951 | A1 * | 4/2015 | Schlenker | E01C 23/088 404/84.05 |
| 2016/0345324 | A1 * | 11/2016 | Shu | H04W 72/0453 |
| 2019/0368135 | A1 | 12/2019 | O'Donnell et al. | |
| 2020/0032464 | A1 | 1/2020 | O'Donnell | |
| 2021/0189667 | A1 * | 6/2021 | Fritz | E01C 19/004 |
| 2022/0290383 | A1 | 9/2022 | Buschmann et al. | |

FOREIGN PATENT DOCUMENTS

| | | | | |
|---|---|---|---|---|
| CN | 108930218 | A | 12/2018 | |
| CN | 108978418 | A | 12/2018 | |
| CN | 110983925 | A | 4/2020 | |
| CN | 217869847 | U | 11/2022 | |
| DE | 102010014695 | A1 * | 10/2011 | E01C 23/088 |
| DE | 112017000242 | T5 * | 8/2018 | E01C 19/48 |
| DE | 102019120060 | A1 | 1/2020 | |
| IN | 202014019027 | A | 11/2020 | |
| JP | 2010085311 | A | 4/2010 | |
| JP | 2011169017 | A | 9/2011 | |
| JP | 2017115387 | A | 6/2017 | |
| JP | 2020204601 | A | 12/2020 | |
| WO | 2020196540 | A1 | 10/2020 | |

OTHER PUBLICATIONS

Search Report, CN Application No. 202210313560.7, dated Sep. 26, 2024, English machine translation.

Chinese Office Action, CN Application No. 202210313560.7, dated Sep. 30, 2024, English machine translation.

CN 102797215 A, English machine translation.

CN 104233934 A, U.S. Pat. No. 9,447,552 B2.

CN 108930218 A, U.S. Pat. No. 11,193,245 B2.

CN 110983925 A, English machine translation.

CN 217869847 U, US 2022/02900383 A1 (Publication of the present application).

Chinese Search Report for CN Application No. 2022103135607, dated Jun. 26, 2025, 4 pages (including English translation).

JPO Office Action in JP Application No. 2020-034263 dated Aug. 13, 2025 (16 pages, including English translation).

Chinese Search Report, CN Application No. 202210313560.7, dated Sep. 26, 2024 (with English machine translation) (6 pages).

Chinese Office Action, CN Application No. 202210313560.7, dated Sep. 30, 2024 (with English machine translation) (10 pages).

JPO Office Action in JP Application No. 2022-034263 dated Feb. 2, 2026, 14 pages (including English translation).

* cited by examiner

METHOD OF PAVING A ROAD SURFACE AND ASPHALT PAVING SYSTEM

CROSS-REFERENCE TO RELATED APPLICATIONS

This application claims foreign priority benefits under 35 U.S.C. § 119(a)-(d) to European patent application number EP 21161843.4, filed Mar. 10, 2021, which is incorporated by reference in its entirety.

TECHNICAL FIELD

The present disclosure refers to a method of paving a road surface and to an asphalt paving system.

BACKGROUND

A plurality of coordinated steps are required for paving, especially for resurfacing, a road surface, wherein a plurality of construction machines are used. For example, a milling machine is used to remove an old road surface and a road paver is used to pave a new road surface. A roller for re-compaction of the new road surface and a feeder vehicle for loading the road paver may also be used. Road surface means all surfaces, preferably based on bituminous or concrete material, which can be produced by a road paver, e.g., roads, cycle paths, sidewalks, parking lots, etc. The construction of new road surfaces is increasingly supported by digital planning data, wherein to increase the quality and efficiency a coordination of the individual paving steps and the individual construction machines shall take place based on the exchange of data. For example, it is known from U.S. Pat. No. 10,563,362 B2 that a road paver can be controlled based on travel path information from a cold milling machine. From DE 10 2019 120 060 A1, the generation of a work site map for a cold milling machine is known, based on sensor information from an autonomous mobile machine.

The known digital systems to support the paving operation of a road surface are directed toward specific subaspects and generate, exchange, or use only a limited amount of digital data.

SUMMARY

It is an object of the present disclosure to provide a method and system for paving a road surface in which digital data is generated and processed to improve paving quality and operating efficiency.

This object is satisfied by the methods and asphalt paving systems as described herein.

A method according to the present disclosure for paving a road surface, in particular resurfacing a road surface, may comprise the following method steps:

- spatially measuring an existing road surface by means of a sensor;
- creating a digital target milling profile of a road base to be milled;
- creating a digital target height profile of a road surface to be paved;
- calculating a layer thickness based on the target milling profile and the target height profile;
- at least partially automatically controlling a milling machine for milling a target milling profile in accordance with the specification of the target milling profile;

- spatially measuring the milled actual milling profile (road base); and
- at least partially automatically controlling a road paver for paving the road surface according to the specification of the target height profile.

The method steps are suitable to be carried out in the order shown herein or otherwise.

The spatial measurement of the existing road surface or the actual milling profile (road base) can take place by a scanning vehicle equipped with one or more suitable measuring devices or sensors driving through the relevant construction zone, whereby the sensors record the data, the respective surfaces are scanned, for example. This can be done by laser measurement technology, ultrasonic technology, infrared technology, optical technology in the visible wavelength range or the like. In addition or alternatively, the embodiments of the method described further below, in particular those in which the sensors are arranged on the milling machine and/or road paver, can be used. However, measuring may also be performed by a device carried or towed by an operator. Similarly, a stationary measuring device can scan a section of the surface to be worked, for example, with swiveling optics. Likewise, aerial measuring using an aerial drone is conceivable. Spatial measuring includes, for example, creating a data set with X, Y, and Z coordinates, i.e., position and/or extension of structures in an X-Y plane, as well as height information in the Z direction. In particular, the X-Y location coordinate of each measuring point can be recorded and associated with measured height information. Recording of the location coordinate can be carried out by receiving a Global Navigation Satellite System (GNSS) signal or by using earth-based reference points. Thus, the extension, dimension and height structure of an existing road surface or an actual milling profile can be recorded as linked data. The same applies to a spatial measurement of a newly paved road surface, as described below.

The creation of a digital target milling profile or a target height profile can be carried out taking into account the measured data. This planning data can be generated automatically and/or by user input to and with a correspondingly suitable data processing unit. The data set can also include the necessary machine parameters or settings. Ideally, the target milling profile as well as the target height profile each comprise the location coordinates X, Y and a height value Z per data point or location coordinate point, just like the data set of the measured existing road surface or the data set of the measured actual milling profile. The respective calculated or measured profiles can thus include the information on the spatial extension in the X, Y and Z directions.

The at least partially automated control of the milling machine or road paver may include the control of all or only some of the functions of the respective machine by an electronic data processing unit. An operator may be present at an operator's platform or other suitable position on or at the construction machine to monitor the operation of the machine and take corrective action if necessary, or generally to operate one or more functions that are not controlled automatically. For this purpose, one or more display elements, operating panels, remote controls and the like may be present.

Preferably, a need for paving material is calculated on the basis of the target milling profile and the target height profile. This can be conveniently done directly after the digital target height profile of the road surface to be paved has been created and the layer thickness has been calculated.

The delivery of the required material can thus be planned and the costs incurred can be calculated.

Preferably, the spatial measurement of the milled actual milling profile, i.e., the produced road base, comprises a comparison of the actual milling profile with the target milling profile. In particular, deviations in the height (Z direction) or extension (dimensions in the X-Y plane) of the actual milling profile from the target milling profile are recorded. The planning data for the new road surface, i.e., in particular the target height profile, can then be adjusted accordingly. For example, an additional area may have to be paved in the X-Y direction if the milled surface is wider than originally planned.

In an advantageous variant, the spatial measurement of the milled actual profile (road base) includes a recalculation of the layer thickness. If, for example, the milled surface was too deep, the originally planned height level of the new road surface can still be maintained by adjusting the layer thickness.

In a preferred variant, the spatial measurement of the milled actual milling profile (road base) includes a recalculation of the paving material requirement. Deviations in both the milling depth and the extension of the milled area have an effect on the requirement for paving material. Thus, by correcting the calculations, the construction site can be supplied with the exact amount of paving material required.

Preferably, the spatial measurement of the milled actual milling profile (road base) takes place by means of at least one measuring device arranged on the milling machine and at least partially during milling. The measuring device, which can be or may comprise one or more of the sensors described above, can be arranged at a rear end of the milling machine, for example. In this way, the already milled area can be scanned or measured while the rotor of the milling machine, which is expediently arranged in a more forward area, is still removing the existing road surface. The measuring device or an element of the milling machine connected to it can have mechanical or electronic means which at least partially compensate for the vibrations generated by the milling for the sensor system. Thus, if the actual milling profile is measured by the milling machine itself, there is no need for a scanning vehicle to travel over the milled surface again, which saves a considerable amount of time.

In one variant, the control of the road paver comprises automatic steering of the road paver depending on the target height profile. The road paver is thus moved in the sense of autonomous driving, whereby it is conceivable that speed and direction of travel are controlled by a data processing unit. For this purpose, as explained above, the target height profile can include the X, Y and Z information for each data or location coordinate point, so that the road paver's travel path is defined on the basis of this spatial information. Thus, the road paver can be controlled with particular precision and an operator is relieved of this task.

It is expedient to control the road paver by automatically controlling one or more sideshifts of a paving screed depending on the target height profile. Retractable and extendable sideshifts define and limit the width of the new road surface and may have outer guide plates for this purpose. If the lateral road surface geometry changes due to bulges or the like, the paving width can be adjusted automatically. For this purpose, all data on the spatial extension, i.e., in particular the X, Y and Z coordinates of the area to be paved, are expediently available in the data record of the target height profile.

In a preferred variant, the control of the road paver comprises automatic control of leveling cylinders and/or of at least one compaction unit depending on the target height profile. Compaction units arranged at the paving screed can be, for example, tamper, screed plate or pressure bar. In this way, an even new road surface can be paved even if the actual milling profile (road base) is uneven. The compaction performance can be adjusted to obtain a constant recompaction height despite varying layer thicknesses for all areas during recompaction by a roller. Likewise, changing road surface profiles over the course of the road can be paved particularly well in this way.

In an expedient variant, a paved actual height profile is measured spatially, in particular at least partially during paving and by means of at least one measuring device arranged on the road paver, and compared with the target height profile. In this way, the paving result can be controlled and the quality of the paving can be ensured.

In an advantageous variant, one or more operating parameters of the road paver are recorded during paving. The recorded data can be compared with the paving result and thus used to ensure the quality of the paving operation. Models can be set up and checked which assign a paving result to certain operating parameters. For example, a paved layer thickness can be predicted for a certain screed position and/or travel speed and/or performance of the compaction units. The area and/or position of the paved layer can be predicted for a specific extending position of the sideshifts and/or an associated travel path. The paving result can therefore already be derived and checked from the machine settings.

In a preferred variant, the creation of a digital target milling profile of a road base to be milled comprises the creation of a travel path of the milling machine and/or the creation of a digital target height profile of a road surface to be paved comprises the creation of a travel path of the road paver. Thus, the creation of the digital planning data can include not only static data, such as the information of a height Z for the respective X-Y location coordinate point, but can also include the machine position as well as other machine parameters. The travel path is ideally planned for areas with a lateral extension greater than the maximum screed width in such a way that the necessary number of passes is minimized. The travel path planning can be carried out automatically by a suitably programmed data processing unit, for example, but can also be created manually.

In a preferred variant, the measured data of the existing road surface and/or of the actual milling profile (road base) and/or of the actual height profile are forwarded to a data processing unit separate from the milling machine or road paver. In this way, for example, the paving of the road surface can be planned and checked on a PC in a planning center. The data can be forwarded by means of radio technology. The data can also be transferred by means of data carriers, for example USB memory, or by means of cables, for example by connecting a laptop to the data processing unit of the respective construction machine, at least temporarily.

An asphalt paving system according to the disclosure may comprise a scanning vehicle, a milling machine and a road paver, each of which has at least one module, such as a GNSS module, for position determination and a data processing unit. The respective data processing unit of the milling machine or the road paver is configured to drive the milling machine or the road paver, respectively, in a position-dependent manner. The scanning vehicle has a measuring device for spatially measuring an existing road surface. The milling machine has a measuring device for spatially measuring a milled actual milling profile (road base) and the road paver has a measuring device for spatially measuring a paved actual height profile. It is also possible for the scanning vehicle to be drivable in a position-dependent manner by means of its data processing unit. In this context, position-dependent drivable means drivable at least partially autonomously, i.e., computer-controlled. The respective vehicle can also have a plurality of modules, such as GNSS modules, for position determination, for example to reference the left and/or right outermost lateral end of a paving screed. Similarly, such data may be obtained by linking a GNSS module located on the construction machine to the dimensions of the construction machine, wherein said dimensions may be variable. For example, the GNSS module may be centered on a road paver and the respective extension width of the paving screed of the road paver may be known via the control of the respective engines or via suitable sensors.

Preferably, at least two of the data processing units are wirelessly connected to each other and/or are each wirelessly connected to a further data processing unit which is arranged separately from the scanning vehicle, milling machine or road paver. In this way, for example, data determined at the respective construction machine can be passed on and/or planning data and/or control commands can be received.

BRIEF DESCRIPTION OF THE DRAWINGS

In the following, embodiments of the disclosure are described in more detail with reference to the Figures.

Components corresponding to each other are marked with the same reference numerals in the Figures.

DETAILED DESCRIPTION

Figure 1:
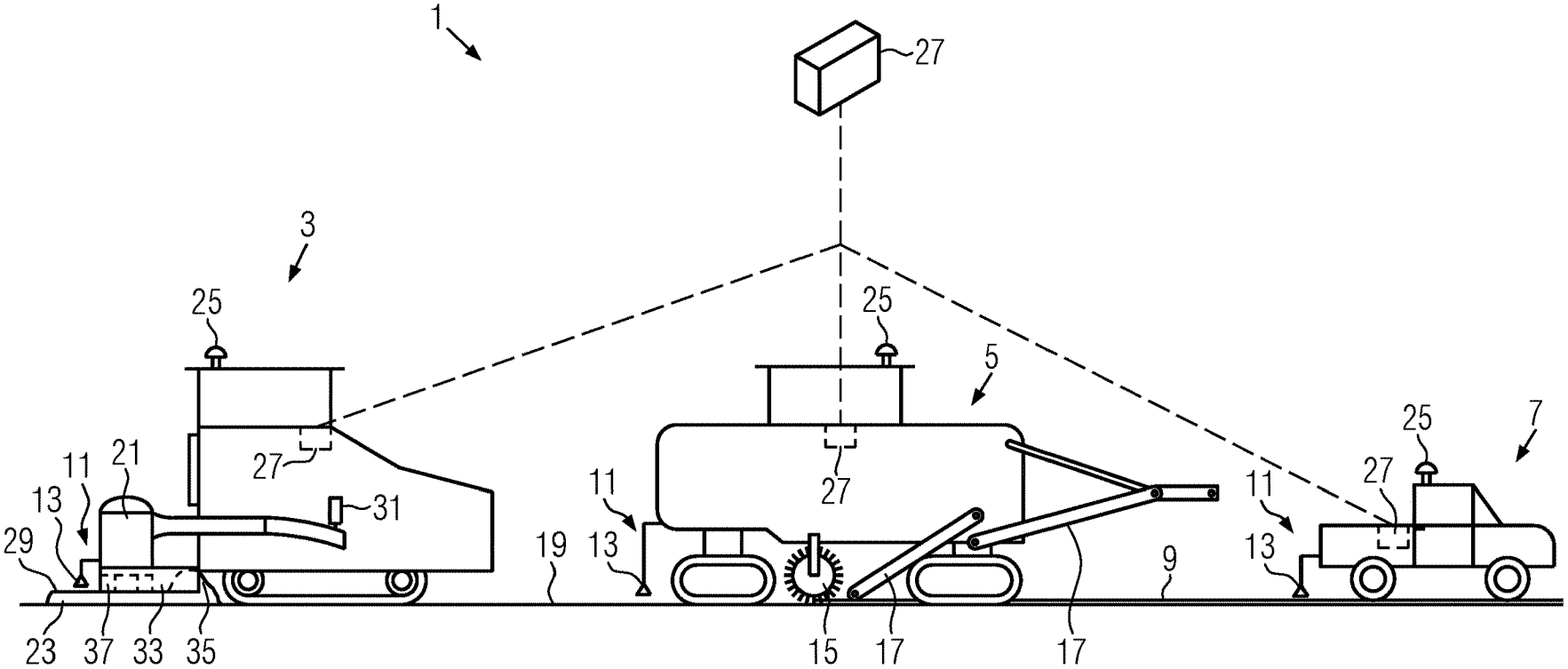
FIG. 1 shows a schematic view of an asphalt paving system comprising a road paver, milling machine and scanning vehicle.

FIG. 1 shows an asphalt paving system 1 with a road paver 3, a milling machine 5 and a scanning vehicle 7. Other vehicles, such as a roller for recompaction, one or more trucks for transporting away an existing road surface 9 that has been milled-out, and one or more trucks for delivering paving material, can also be part of the asphalt paving system 1, but are not shown here. The scanning vehicle 7 has a measuring device 11 for spatially measuring the ground over which it moves, particularly the existing road surface 9. The measuring device 11 may comprise one or more sensors 13, for example laser sensors, which detect a laser beam previously emitted and reflected by the ground. The milling machine 5 has one or more rotors 15, which mill out the existing road surface 9 by rotation. The milled-out material can be transferred to a truck via conveyor belts 17. The road paver 3 travels over a road base or actual milling profile 19 left behind by the milling machine 5 and uses a paving screed 21 to lay a new road surface 23, for example of asphalt material or concrete material. The road paver 3, milling machine 5 and scanning vehicle 7 may each have a GNSS module 25 for receiving a satellite signal for position determination. Alternatively or additionally, position determination can be performed by local devices, such as laser reference systems.

The vehicles 3, 5, 7 each include a data processing unit 27, although there may also be one or more data processing units 27 separate from the vehicles 3, 5, 7. The data processing units 27 may include data storage, processor as well as communication interfaces. In particular, the data processing units 27 may be wirelessly connected to each other to exchange data, as indicated here by the dashed lines. In addition, the data processing units 27 may each process any data relating to the respective vehicle 3, 5, 7, including, for example, satellite signals received by the GNSS module 25, such that the GNSS modules 25 essentially act merely as antennas. The milling machine 5 and the road paver 3 also each have at least one measuring device 11 for spatially measuring a milled road base (actual milling profile) 19 and a paved actual height profile 29, respectively. The measuring devices 11 can be of the same or different design and mode of operation.

It is noted that each data processing unit 27 and/or any other unit, control unit, controller, personal computer, computer, server, control, machine, sensor, device, module, console, display, display element, operating panel, remote control, arrangement, feature, system, functionality, step, algorithm, operation, or the like described herein may comprise and/or be implemented in or by one or more appropriately programmed processors (e.g., one or more microprocessors including central processing units (CPU)) and associated memory and/or storage, which may include data, firmware, operating system software, application software and/or any other suitable program, code or instructions executable by the processor(s) for controlling operation thereof and/or for performing the particular algorithms represented by the various functions and/or operations described herein, including interaction between and/or cooperation with each other. One or more of such processors, as well as other circuitry and/or hardware, may be included in a single ASIC (Application-Specific Integrated Circuitry) or individually packaged or assembled into a SoC (System-on-a-Chip). As well, several processors and various circuitry and/or hardware may be distributed among several separate components and/or locations, such as a road construction machine, a mobile unit or mobile computing device, or a remote server.

The road paver 3 has a leveling cylinder 31 on its left and right side, respectively, which is used to set the towing point height of the paving screed 21. The paving screed 21 has sideshifts 33 on its left and/or right side, which laterally limit the feed of the paving material 35 and thus define the paving width. The sideshifts 33 can be arranged by means of laterally extendable screed elements and thus be arranged in variable screed width and essentially hold the paving material 35 at a desired width by means of a vertical plate. The paving screed 21 includes one or more compaction units 37, such as a tamper, screed plate or pressure bar, to pave the paving material 35 at the desired compaction.

Figure 2:
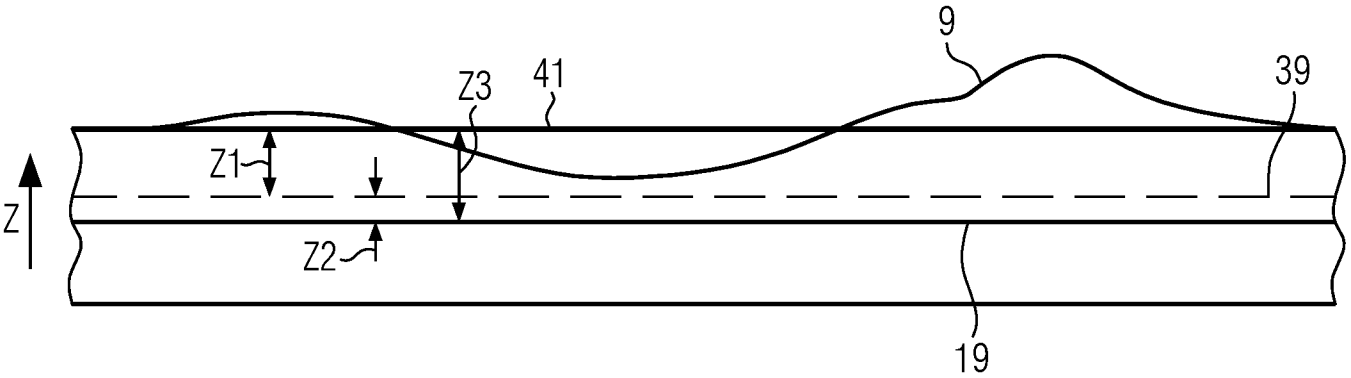
FIG. 2 shows a schematic sectional view of a road surface at different manufacturing steps.

FIG. 2 shows a schematic sectional view to illustrate the height in the Z-direction of a road surface at different manufacturing steps. In this example, an existing road surface 9 has unevenness, such as ruts, and is provided for renewal and is first measured spatially. Then the digital target milling profile 39 (dashed line) is created, i.e., planned by an operator on a PC, for example, or created automatically using suitable software. Then the digital target height profile 41 of the new road surface is created digitally, i.e., planned. The target height profile 41 thus specifies the road surface height, including possibly desired slopes, roof profiles or the like. The layer thickness Z1 of the new road surface and thus the required quantity of paving material 35 is thus known. The actual milling profile 19 milled by means of the milling machine 5, i.e., the road base, may deviate from the intended height of the target milling profile 39, as shown here, for example, it may be lower because more material was milled out. In order to obtain information on the actual height and also the spatial extension in width and length (X-Y direction) of the milled actual milling profile 19, this is measured spatially. The actual milling profile 19 can be compared with the target milling profile 39 and deviations Z2 of the layer thickness can be detected. Based on the measured actual milling profile 19, the layer thickness Z3 (=Z1+Z2) actually required can be detected in order to achieve the desired paving height of the target height profile 41.

Figure 3:
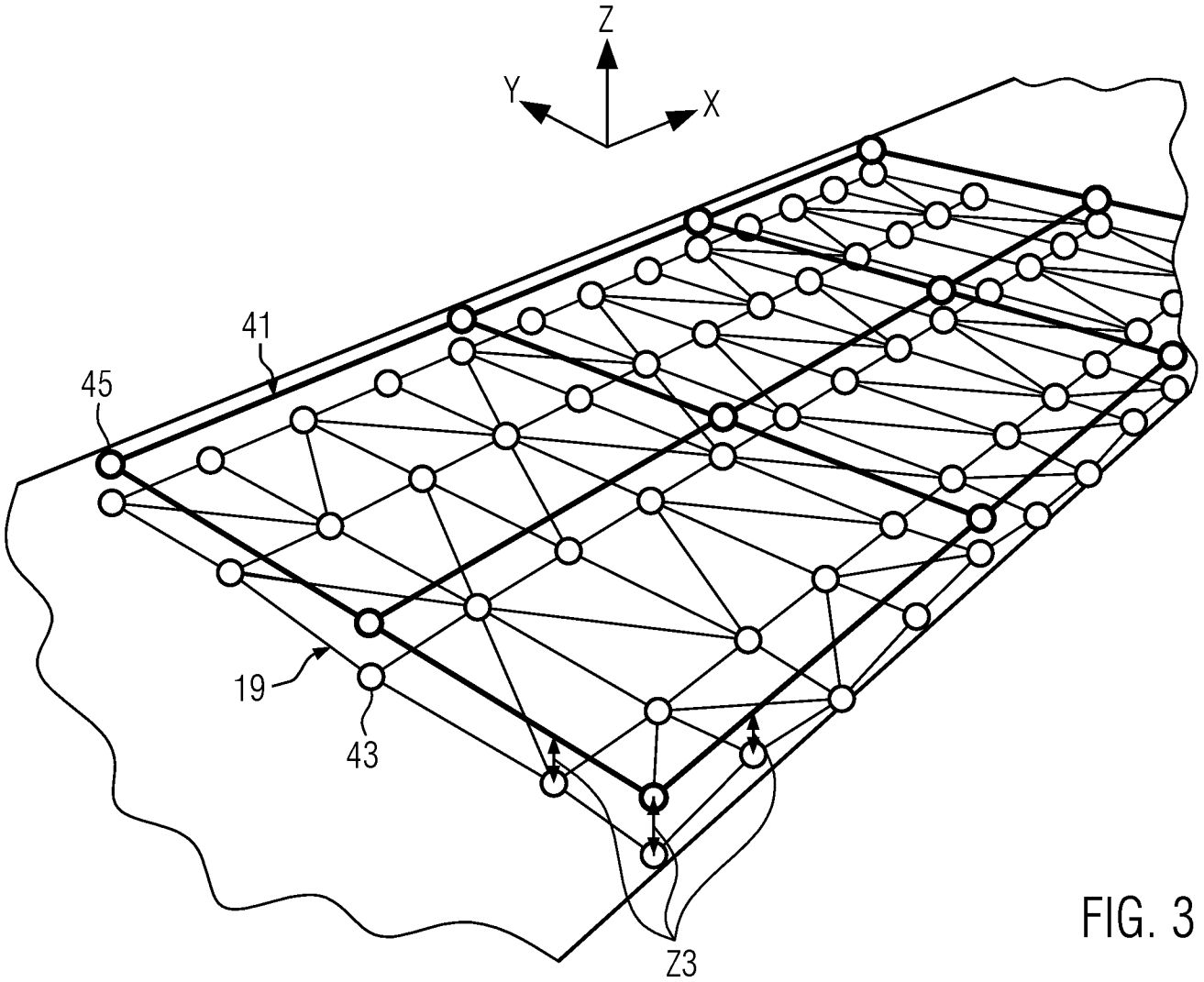
FIG. 3 shows a schematic three-dimensional view of planning and manufacturing data.

FIG. 3 shows a schematic three-dimensional view of planning and production data. The data points of the actual milling profile 19, i.e., the road base, are shown as the lower grid. It makes sense that the data points 43 of the actual milling profile 19 correspond to a resolution of the measuring systems, i.e., GNSS measurement or road surface scan. The upper grid represents the data points 45 of the target height profile 41, i.e., the digital planning data of the layer to be paved. The number of data points 43, 45 of the two profiles 19, 41 may be different. The data includes the extension of the structure in the X-Y direction and the height data in the Z direction. As can be seen, the milled road base 19 may have unevenness, so that the height Z3, i.e., the distance to the target height profile 41, is variable as a function of the X-Y coordinate.

Figure 4:
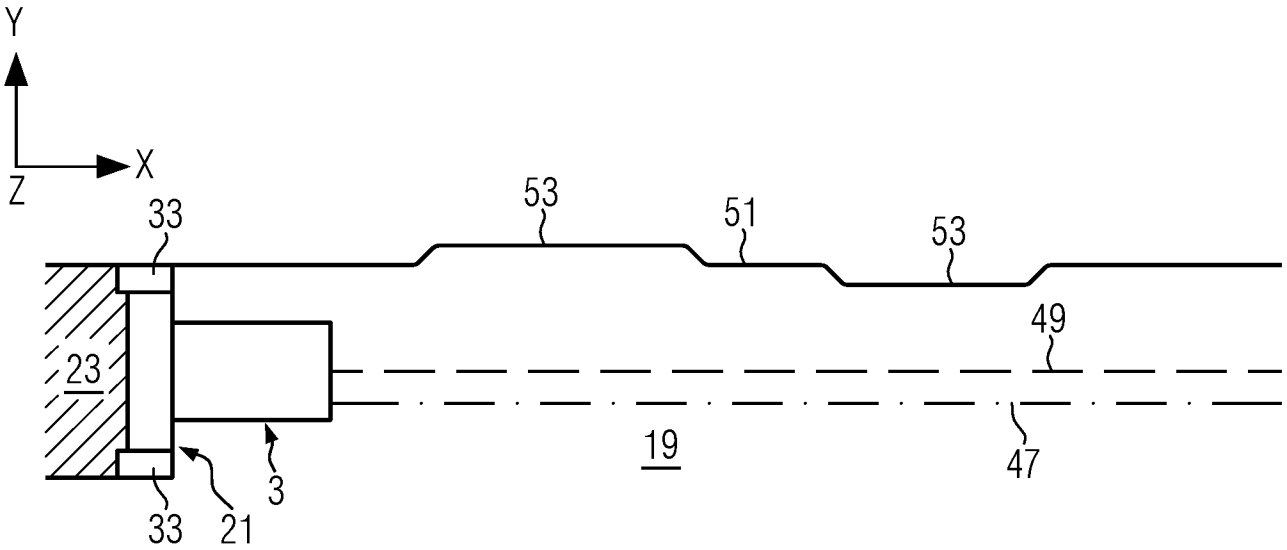
FIG. 4 shows a schematic top view of a section of a road surface to be paved.

FIG. 4 shows a schematic top view of a section of a road surface to be paved. A milling machine 5 has already produced the actual milling profile or road base 19 by traveling along its travel path 47. The road paver 3 now follows the path 49 planned for it, which, as shown here, differs from the travel path 47 of the milling machine 5 but can also be the same as it. The lateral boundary 51 of the road can have inward or outward bulges 53. When paving the new road surface 23, therefore, the road paver 3 can be controlled so that the sideshifts 33 of the paving screed 21, and thus its paving width, are automatically adjusted to the varying road surface width. In particular, the sideshift 33 of one side of the paving screed 21 can be controlled independently of that of the other side in each case. The maximum and minimum possible widths of the paving screed 21 and the variable road surface width are taken into account when planning the travel path 49. For areas to be paved that are wider than the maximum width of the paving screed 21, the travel path 49 of the road paver 3 or of a plurality of road pavers 3 is planned in such a way that the number of passes is minimized.

Based on the above embodiments of a method for paving a road surface, many variations of the same are possible. All or some of the vehicles 3, 5, 7 can be driven and operated partially or fully automated, i.e., computer-controlled. Likewise, other vehicles such as rollers or feeders can be operated at least partially automatically, in particular autonomously.

What is claimed is:

1. A method of paving a road surface, the method comprising:

spatially measuring an existing road surface by a sensor;

creating a digital target milling profile;

creating a digital target height profile of a road surface to be paved;

calculating a layer thickness based on the target milling profile and the target height profile;

at least partially automatically controlling a milling machine for milling an actual milling profile according to a specification of the target milling profile;

spatially measuring the milled actual milling profile wherein spatially measuring the milled actual milling profile comprises comparing the actual milling profile with the target milling profile, recording deviations in a height or an extension of the actual milling profile from the target milling profile, and adjusting planning data for a new road surface, wherein the planning data for the new road surface comprises the target height profile; and at least partially automatically controlling a road paver for paving the road surface in accordance with a specification of the target height profile.

2. The method according to claim 1, further comprising calculating a need for paving material based on the target milling profile and the target height profile.

3. The method of claim 1 wherein the target height profile and the actual milling profile are three-dimensional data.

4. The method according to claim 2, wherein spatially measuring the milled actual milling profile comprises recalculating the need for paving material.

5. The method according to claim 1, wherein spatially measuring the milled actual milling profile comprises recalculating the layer thickness.

6. The method according to claim 1, wherein spatially measuring the milled actual milling profile is carried out by at least one measuring device arranged on the milling machine and at least partially during milling.

7. The method according to claim 1, wherein controlling the road paver comprises automatically steering the road paver depending on the target height profile.

8. The method according to claim 1, wherein controlling the road paver comprises automatically controlling one or more sideshifts of a paving screed depending on the target height profile.

9. The method according to claim 1, wherein controlling the road paver comprises an automatic controlling of leveling cylinders and/or at least one compaction unit in dependence on the target height profile.

10. The method according claim 1, wherein creating a digital target milling profile comprises creating a travel path of the milling machine and/or wherein creating a digital target height profile of a road surface to be paved comprises creating a travel path of the road paver.

11. The method according to claim 1, further comprising spatially measuring a paved actual height profile at least partially during paving and by at least one measuring device arranged on the road paver, and comparing the paved actual height profile with the target height profile.

12. The method according to claim 11 further comprising passing measured data of the existing road surface and/or of the actual milling profile and/or of the actual height profile to a data processing unit separate from the milling machine or the road paver.

13. An asphalt paving system comprising:

a scanning vehicle;

a milling machine; and a road paver;

wherein each of the scanning vehicle, the milling machine, and the road paver has at least one module for position determination and a respective data processing unit;

wherein the respective data processing unit of the milling machine or the road paver is configured to drive the milling machine or the road paver in each case depending on its position;

wherein the scanning vehicle has a measuring device for spatially measuring an existing road surface; and wherein the milling machine has a measuring device for spatially measuring a milled actual milling profile and the road finisher has a measuring device for spatially measuring a paved actual height profile, wherein the asphalt paving system is configured to perform the method of paving a road surface according to claim 1.

14. The asphalt paving system according to claim 13, wherein at least two of the data processing units are wirelessly connected to each other and/or are each wirelessly connected to a further data processing unit which is arranged separately from the scanning vehicle, the milling machine, or the road paver.

15. The asphalt paving system according to claim 13 wherein the data processing unit of the milling machine or the road paver is configured to calculate a layer thickness based on a target milling profile and a target height profile.

16. The asphalt paving system according to claim 15 wherein the data processing unit of the milling machine or the road paver is configured to calculate a need for paving material based on the target milling profile and the target height profile.

17. The asphalt paving system according to claim 15, wherein the measuring device for spatially measuring the milled actual milling profile is configured to compare the milled actual milling profile with the target milling profile.

18. The asphalt paving system according to claim 15, wherein the measuring device for spatially measuring the milled actual milling profile is configured to recalculate the layer thickness.

19. A method of paving a road surface, the method comprising:

creating a digital target milling profile;

creating a digital target height profile of a road surface to be paved;

calculating a layer thickness based on the target milling profile and the target height profile;

at least partially automatically controlling a milling machine for milling an actual milling profile according to a specification of the target milling profile;

spatially measuring the milled actual milling profile wherein spatially measuring the milled actual milling profile comprises comparing the actual milling profile with the target milling profile, recording deviations in a height or an extension of the actual milling profile from the target milling profile, and adjusting planning data for a new road surface, wherein the planning data for the new road surface comprises the target height profile; and at least partially automatically controlling a road paver for paving the road surface in accordance with a specification of the target height profile.

20. The method of claim 19 wherein paving a road surface comprises resurfacing a road surface.

* * * * *